US005782466A

United States Patent [19]

Regimbal et al.

[11] Patent Number: 5,782,466

[45] Date of Patent: Jul. 21, 1998

[54] MEDIA PROCESSING HAVING INTERMEDIATE FINISHING OPERATIONS AND A REMOTE OUTPUT STORAGE LOCATION

[75] Inventors: Laurent A. Regimbal, Eagle, Id.; Lenin Gallegos, San Agustin Jalisco, Mexico; Martha Patricia Salas Sanchez, Jalisco, Mexico; Francisco J. Camino-Escudero; Carlos F. Becerra Jimenez, both of Guadalajara Jalisco, Mexico; Roberto Obregon, La Castellana Zapopan Jalisco, Mexico

[73] Assignee: Hewlett-Packard Company, Palo Alto, Calif.

[21] Appl. No.: 748,465

[22] Filed: Nov. 8, 1996

[51] Int. Cl.[6] ..... B31B 1/68

[52] U.S. Cl. ..... 270/58.08; 270/58.14; 270/58.19

[58] Field of Search ..... 270/58.01, 58.02, 270/58.08, 58.12, 58.14, 58.16, 58.19, 58.2, 58.21, 58.22, 58.23, 58.28

[56] References Cited

U.S. PATENT DOCUMENTS

| | | | |
|---|---|---|---|
| 4,073,391 | 2/1978 | O'Brien et al. | 270/58.17 |
| 4,878,656 | 11/1989 | Honjo et al. | 270/58.09 |
| 4,898,372 | 2/1990 | Hirabayashi et al. | 270/58.12 |
| 4,917,364 | 4/1990 | Iida et al. | 270/58.17 |
| 5,129,640 | 7/1992 | Kosaka et al. | 270/58.12 |
| 5,288,062 | 2/1994 | Rizzolo et al. | 270/58.12 |
| 5,374,043 | 12/1994 | Mandel et al. | 270/58.14 |
| 5,531,430 | 7/1996 | Tokunoh | 270/58.19 |

*Primary Examiner*—David A. Okonsky
*Attorney, Agent, or Firm*—Lane R. Simmons

[57] ABSTRACT

Finishing operations on media processing jobs, such as from laser printer or photocopier devices, are performed in an intermediate output bin and subsequently transferred to a final output bin. One or more finishing mechanisms are disposed to cooperate with the intermediate output bin for performing finishing operations on the media in sequential order. A transfer mechanism operates to move the media from finishing operation to finishing operation in the intermediate output bin, and subsequently to the final output bin once the finishing operations are complete. The final output bin is thus capable of storing multiple finished jobs. The finishing operations may be a registration (alignment) process, a binding process, a hole punching process, and the like.

20 Claims, 6 Drawing Sheets

MEDIA PROCESSING HAVING INTERMEDIATE FINISHING OPERATIONS AND A REMOTE OUTPUT STORAGE LOCATION

FIELD OF THE INVENTION

This invention relates in general to media processing and, more particularly, to preparing and processing paper for finishing operations relative to a remote output storage location.

BACKGROUND OF THE INVENTION

Many image forming apparatus, such as laser printers and copy machines, employ automated stapling mechanisms which act upon the media after completion of imaging or other general processing. In addition, these apparatus may also perform various other finishing operations on the media, such as binding, hole punching, or the like. In each case, the media (generally paper) must be aligned along one or more prescribed axes for proper stapling, binding, punching, etc. Proper alignment (registration) is key to providing accurate and satisfactory finishing operations upon the media.

Conventional methods and devices arrange (align) the output media, perform the finishing operation, and store the finished output media all at one fixed location, generally designated as an output bin or output tray. Although it is often considered "space efficient" to accomplish multiple tasks in a single output bin, there are significant disadvantages that accompany such conventional techniques. Specifically, a single, multi-task capable processing location (output bin) generally limits the number of finished jobs and, therefore, output capacity, that can be produced at that location. This is generally equal to or less than the number of output bins the media processing device (photocopier, printer, etc.) employs. For example, once a job is registered and stapled in a designated bin, no other job can be finish processed in that bin without an operator or user first removing that original job from the bin. For purposes of this disclosure, a "job" means, generally, any media that is or has been processed through a finishing operation, such as registration, binding or hole-punching.

Another disadvantage of the single, multi-task capable output bin that does not transfer the job for the differing operations is that the product architecture for such a bin is potentially more difficult than desirable because of the differing operations being performed in one same location.

Accordingly, objects of the present invention include providing a new means and method for allowing finishing operations to be performed on multiple jobs without inhibiting the flow of jobs at a particular output bin.

SUMMARY OF THE INVENTION

According to principles of the present invention in a preferred embodiment, finishing operations on media processing jobs, such as from laser printer or photocopier devices, are performed in an intermediate output bin and then subsequently transferred to a final output bin upon completion. Multiple finishing mechanisms are disposed to cooperate with the intermediate output bin for performing finishing operations on the media in a sequential order. A transfer mechanism operates to move the media from finishing operation to finishing operation, and subsequently from the intermediate output bin to the final output bin once the finishing operations are complete. The final output bin is thus capable of storing multiple finished jobs. The finishing operations may be a registration (alignment) process, a binding process, a hole punching process, and the like.

Advantages of the present invention include: (i) multiple documents can be stored in one final output bin; (ii) multiple finishing operations can be performed on the same output media in sequential order; and (iii) since the locations for the finishing operations are separate and independent of each other in the intermediate output bin, mechanical design implementation is flexible.

Other objects, advantages, and capabilities of the present invention will become more apparent as the description proceeds.

DETAILED DESCRIPTION OF THE INVENTION

Figure 1:
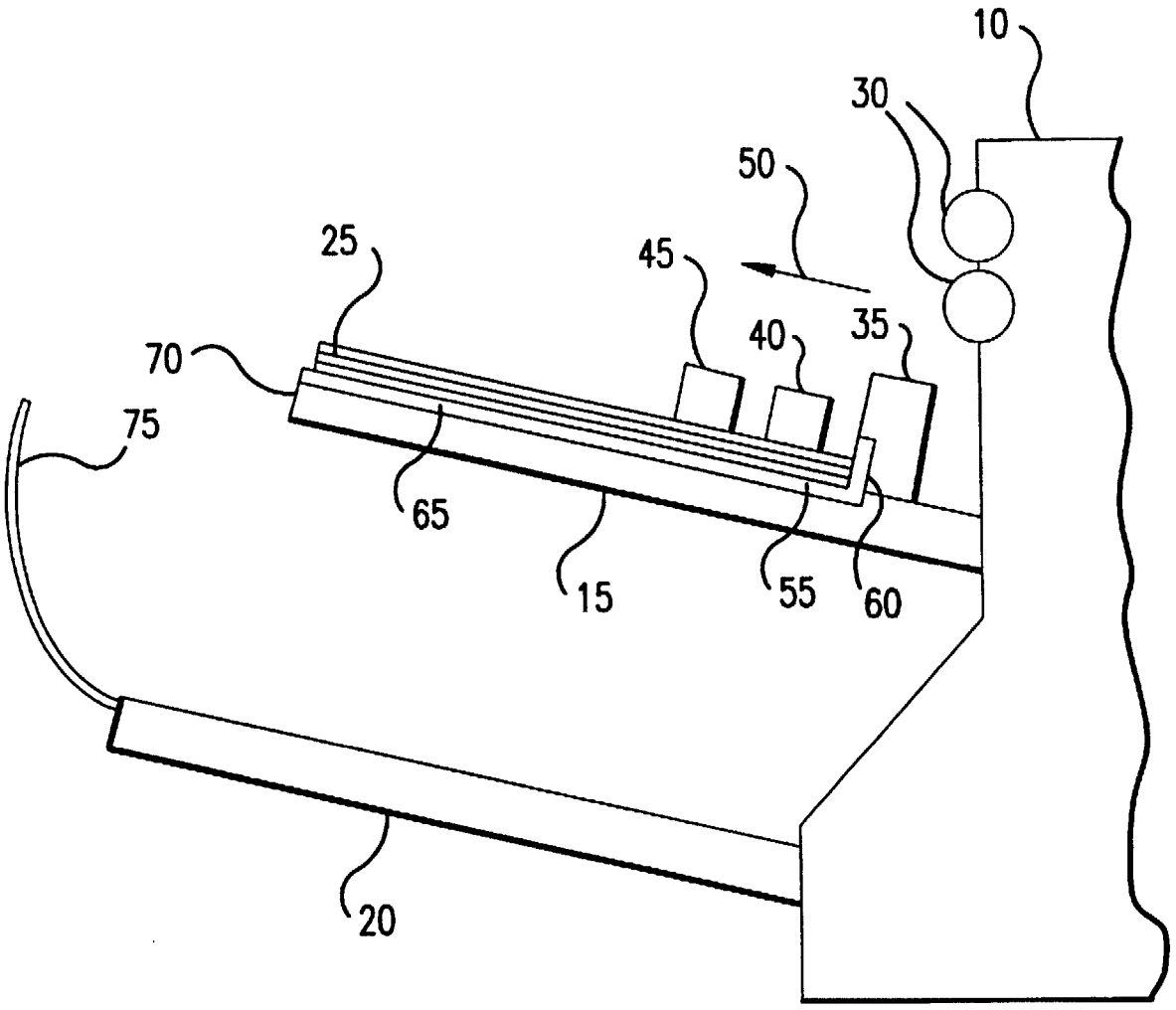
FIG. 1 is a side elevation view block diagram of the present invention media processing apparatus having intermediate finishing operations and a remote output storage location.

FIG. 1 is a side elevation view block diagram of the present invention media processing apparatus having intermediate finishing operations and a remote output storage location. Paper deliver head 10 is adapted to cooperate with first and second output trays 15 and 20 (also termed bins or holding beds) for finish processing of media 25. Throughout this disclosure, it will be understood that paper deliver head 10 is a component adapted to cooperate with any conventional media processing apparatus (not shown), such as a laser printer, photocopy machine, facsimile device, or other paper handling device that is configured to align media for finish processing or the like. It will also be understood that the terms medium and media are used generally to mean any sheet of paper, envelope, cardstock, transparency, or other medium capable of being used in image processing devices or other media processing devices.

Paper delivery head 10 is configured to deliver media 25 to output tray 15 via feed rollers 30. Media 25 is delivered over registration wall 35, one sheet at a time. Although the drawing actually depicts three sheets being held by tray 15, the sheets are referred to generally as media 25 for purposes of this description. Media 25 defines one "job" that is being finish processed.

Registration mechanism 40 operates in connection with registration wall 35 to align media 25 along the "x" and "y" axes of the media processing path. Various techniques exist in the art for aligning media and, as such, registration wall 35 and mechanism 40 are shown merely as block symbols for simplicity of drawing purposes. The important aspect, however, is that registration wall 35 and mechanism 40 provide the conventional finishing operation of accurately aligning media 25 for subsequent binding, stapling, hole punching, or the like.

Stapling device 45 is disposed adjacent registration mechanism 40 in cooperation with first output tray 15. Stapling device 45 is also shown merely in block diagram as being exemplary of any conventional binding device that acts upon media 25 as a finishing operation. Stapling device 45 is located "downstream" from registration mechanism 40, "downstream" being relative to the media processing path. Although output tray 15 (and also 20) is angled slightly upward relative to gravitational forces to assist in holding media 25 therein and against registration wall 35, the term "downstream" refers to the media processing path originating from feed rollers 30 and continuing in the direction depicted generally by directional arrow 50.

One of the novel aspects of the present invention is that output tray 15 is an intermediate output tray relative to complete processing of media (job) 25. Specifically, all finishing operations are performed on media 25 at intermediate output tray 15, but when the operations are completed, the media does not remain in tray 15 as would occur with the conventional art. Rather, upon "completion" of the job with respect to intermediate tray 15, the present invention transfers media 25 to second output tray 20. As such, tray 20 is the final output tray for the job wherein no further finish processing occurs. The media simply sits in tray 20 until an operator or user removes it from the tray. In this manner, multiple jobs may be processed through intermediate output tray 15 and, subsequently, transferred to final output tray 20 where the jobs are automatically stacked until retrieved by the user.

Another novel aspect of the present invention is that binding mechanism 45 is disposed downstream from registration mechanism 40. This allows for significant design flexibility of the system. Specifically, although only two finishing mechanisms (operations) are shown, there could easily be other finishing mechanisms disposed in connection with tray 15 and downstream from stapling mechanism 45 and registration mechanism 40. For example, a hole punching operation could also be implemented subsequent to stapling. In any case, the linear positioning of these finishing mechanisms and operations provides broad flexibility to the system.

The transfer of media 25 from one finishing operation to the next, and from intermediate output tray 15 to final output tray 20, occurs in connection with push arm 55. Arm 55 is disposed to slidably operate in cooperation with intermediate tray 15, and includes back support lip 60 and bottom support 65. Back support lip 60 pushes against the edge of media 25 for effectuating transfer operations of the media. For example, during registration of the media, back support lip 60 is flush with registration wall 35. But when registration is complete, arm 55 is slid forward (downstream), with back support lip 60 catching and pushing (or "pulling") media 25 along with the arm. The arm and media are slid forward to stapling mechanism 45 whereby the media is then stapled. Arm 55 thus transfers media 25 to each finishing operation station that exists (two in this example). Although arm 55 is disclosed as a preferred embodiment, it is understood that other forms of mechanical forces may also be used to transfer the media.

When all finishing operations are completed, arm 55 then pushes media 25 (the job) over end 70 of tray 15. As the job is pushed over the end and begins to fall, deflection arm 75 directs the media down toward final output tray 20 where the job remains until retrieved by the user. It should also be noted here that although only one final output tray 20 is shown for ease of discussion purposes, it will be obvious that multiple final output trays could be used for receiving media 25 after completion of finishing operations in intermediate tray 15. Specifically, deflection arm 75, or some other directional device, would deflect each completed job to a selected final output tray.

In the meantime, if a next job needs to be finish processed, intermediate output tray 15 may begin receiving that newly received media from feed rollers 30, proceed with finishing operations on it, and then transfer it down to final output tray 20 to rest on top of the first job (if the first job hasn't yet been removed). In this manner, jobs may continue to be finish processed (including aligned, bound, punched, etc.) by intermediate tray 15, and then subsequently transferred to final output tray 20 in final finished form. It may be noted that although deflection arm 75 is shown as being supported by final output tray 20, it may just as easily be supported by intermediate tray 15 or some other feasible means. In any case, the design is not critical so long as the deflection arm directs the job appropriately to fall to the lower tray.

Figure 2:
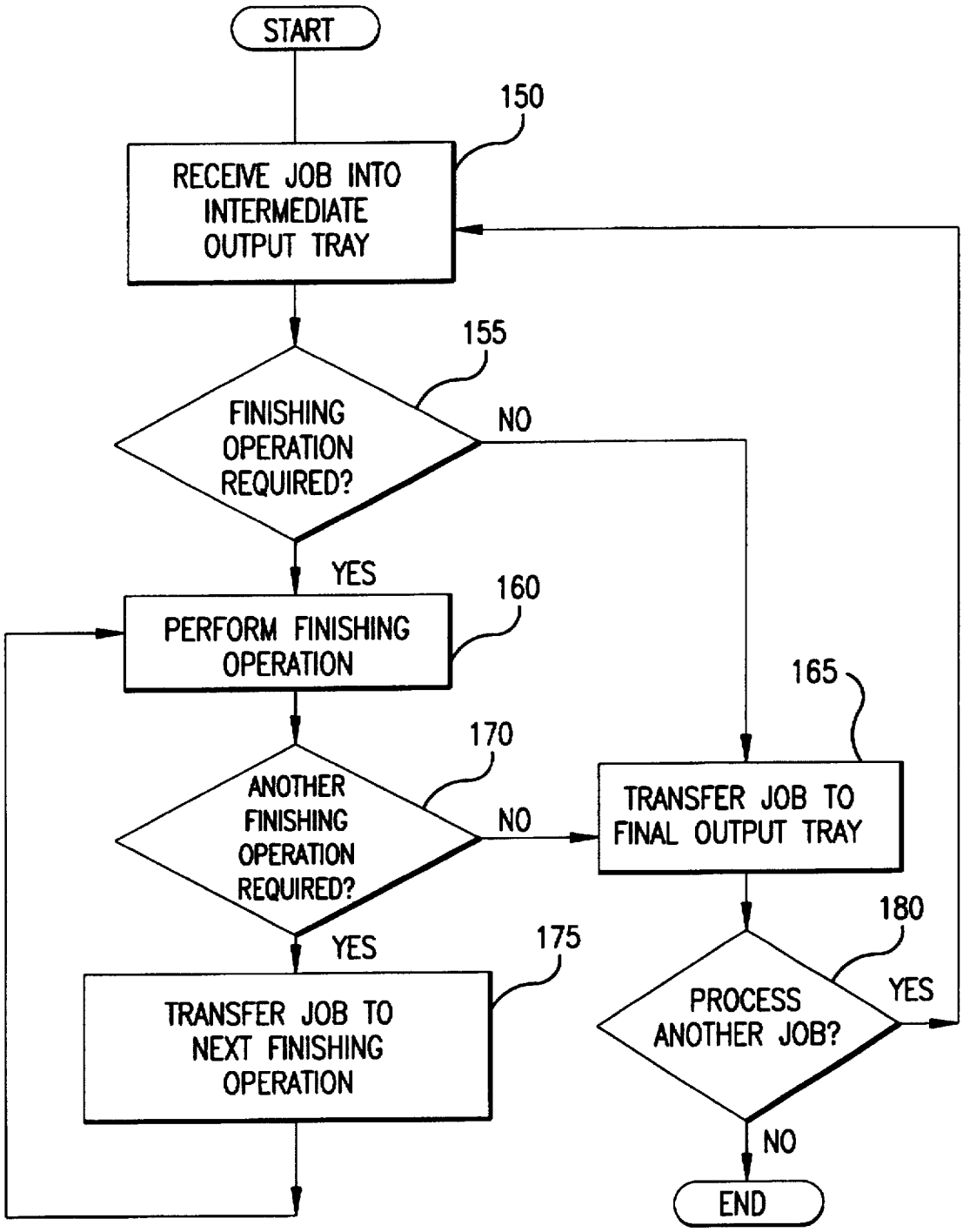
FIG. 2 is a flow chart depicting a preferred method of the present invention.
Figure 3:
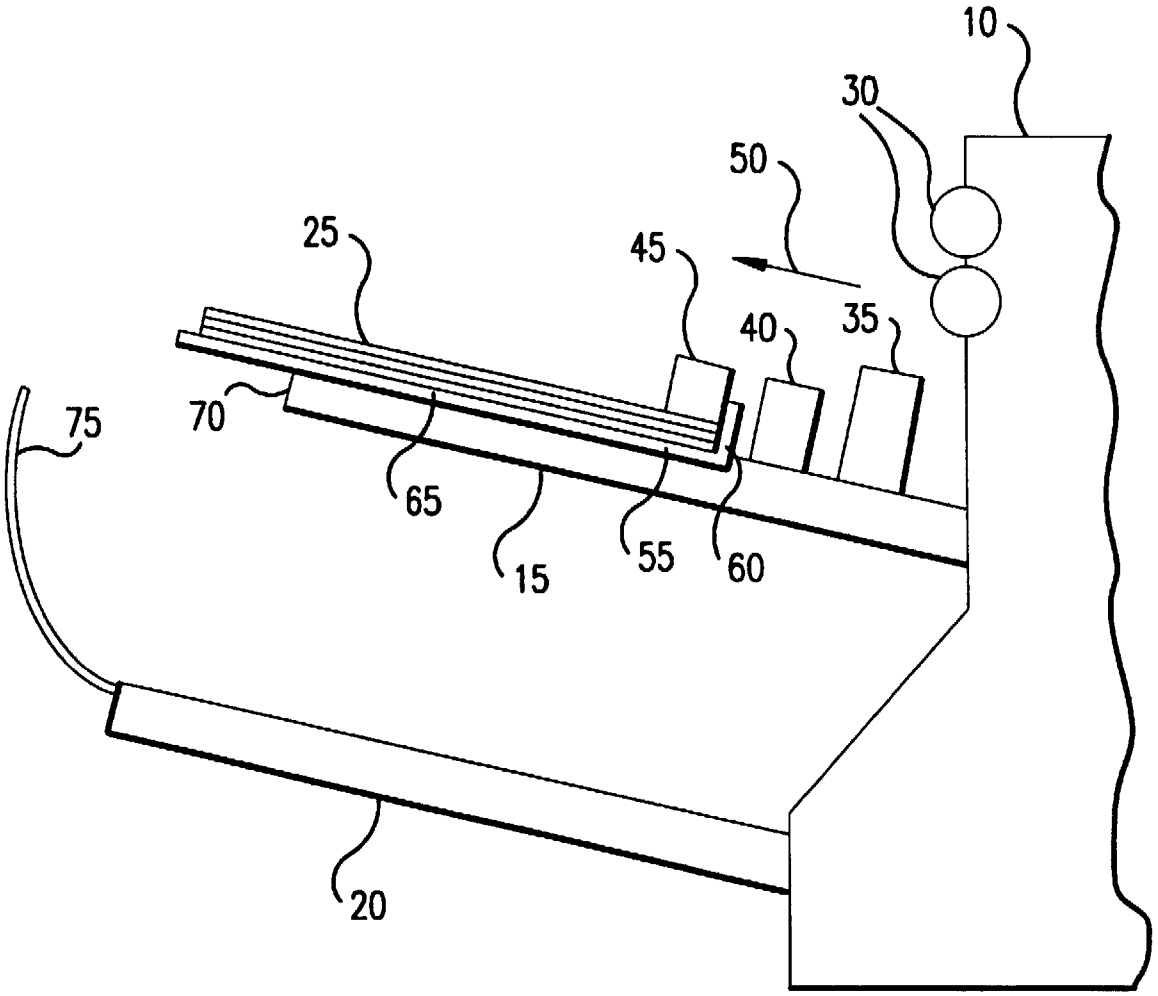
FIGS. 3–6 are side elevation view block diagrams depicting "snap shots" of differing stages of the present invention as a job is processed from an intermediate, finishing operations output tray to a final output tray.

Referring now to FIG. 2, a flow chart depicts a preferred method of the present invention as it relates to FIG. 1, and further to FIGS. 3–6. First, 150, a job (media 25) is received into intermediate output tray 15. Then, if a finishing operation is to occur for the job 155, the finishing operation is performed 160. As previously described, the finishing operation may be, for example, aligning (registration) of the media in preparation for other finishing operations. These steps thus far are "snap shot" depicted by FIG. 1. If, on the other hand, no finishing operation is to occur 155, then the job is immediately transferred 165 to final output tray 20. Although this step is unlikely to occur, it exists as a precautionary measure.

Subsequently, if one finishing operation has been performed 160 and another is to be performed 170, then the job is transferred 175 to the next finishing operation, and that operation is then performed 160. The next operation may be, for example, binding (such as stapling) the media. This step is "snap shot" depicted in FIG. 3 where push arm 55 is shown as having moved media 25 forward (relative to media processing direction 50), and is positioned at binding mechanism 45 for stapling of the media.

Figure 4:
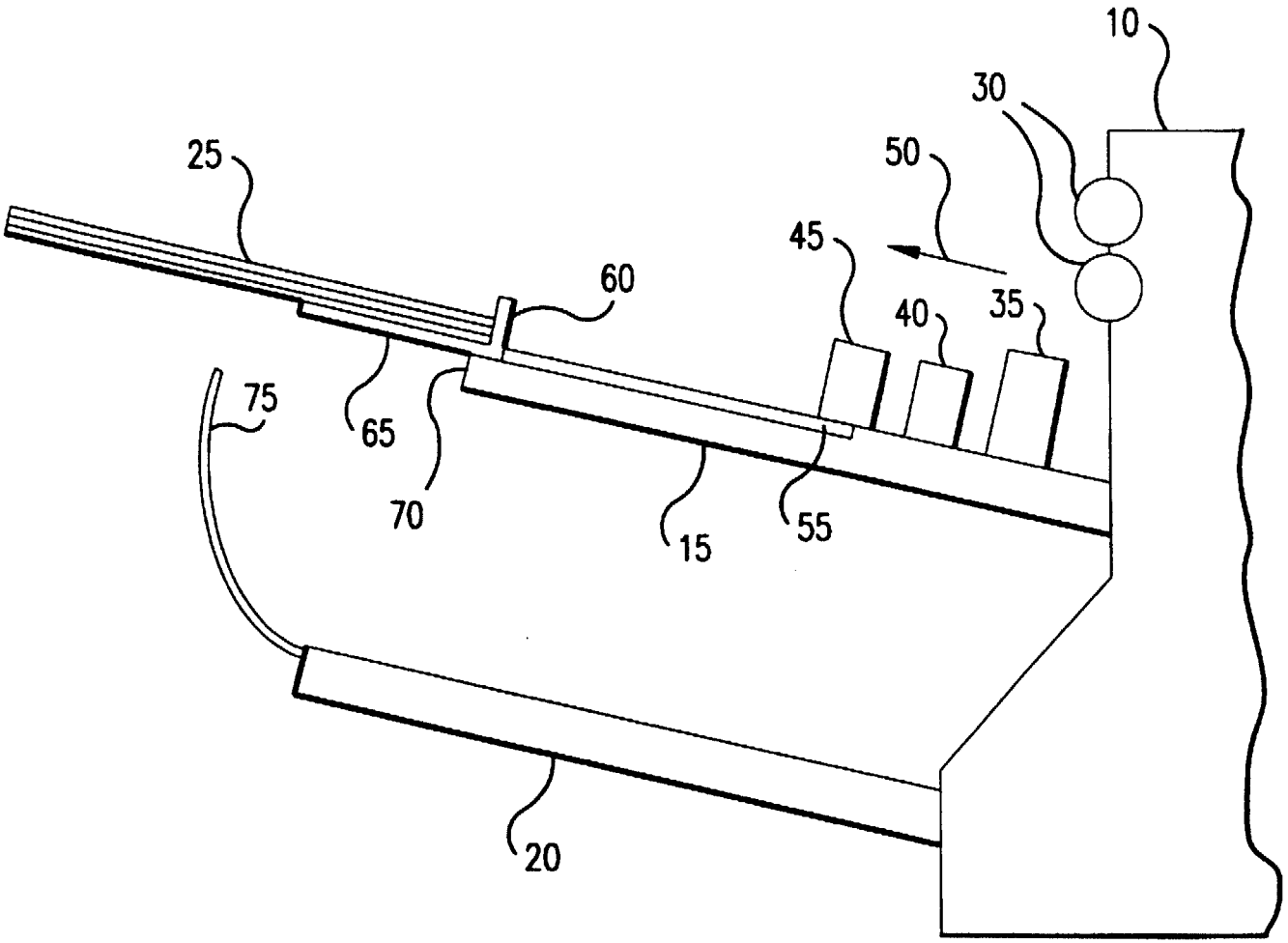
Figure 5:
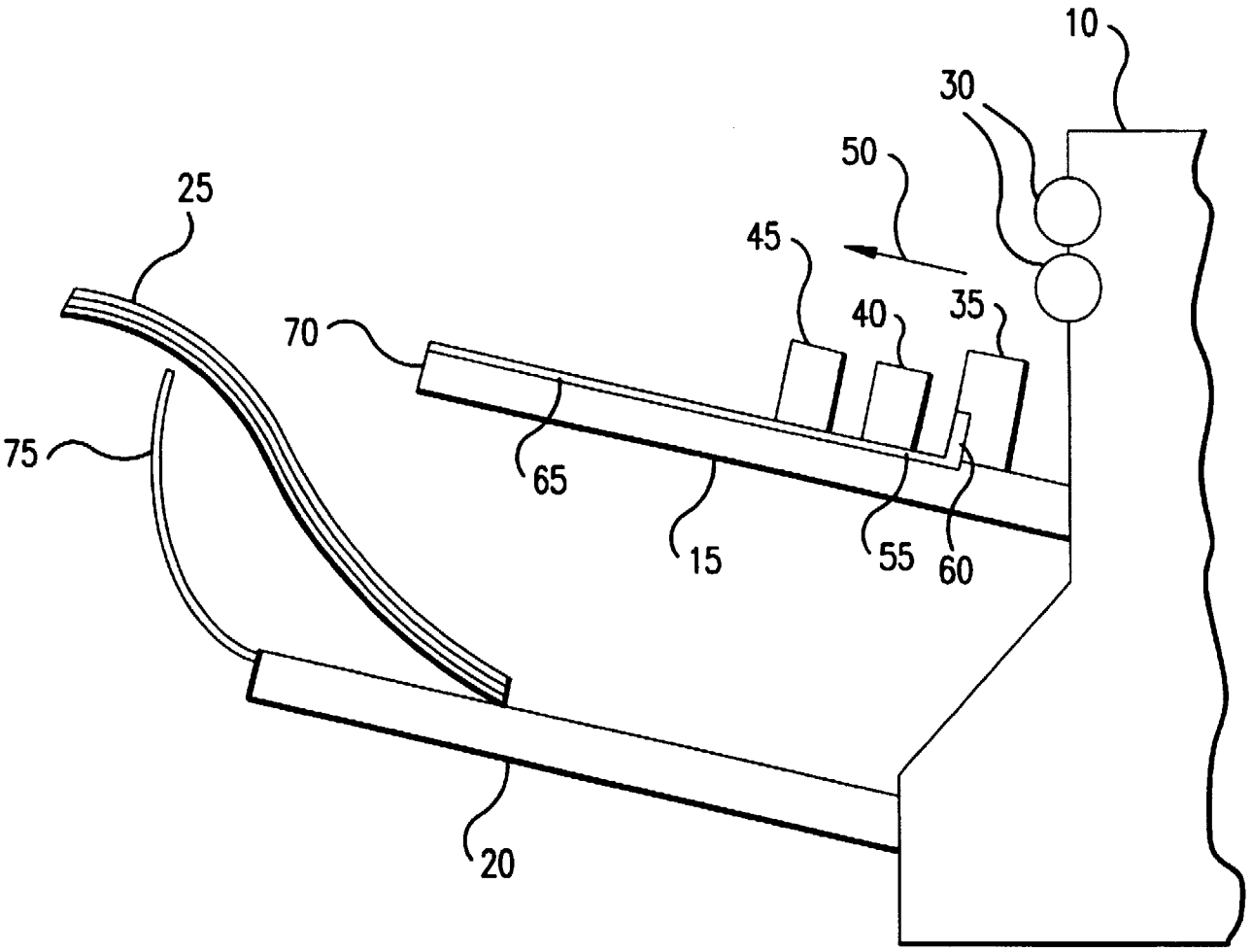
Figure 6:
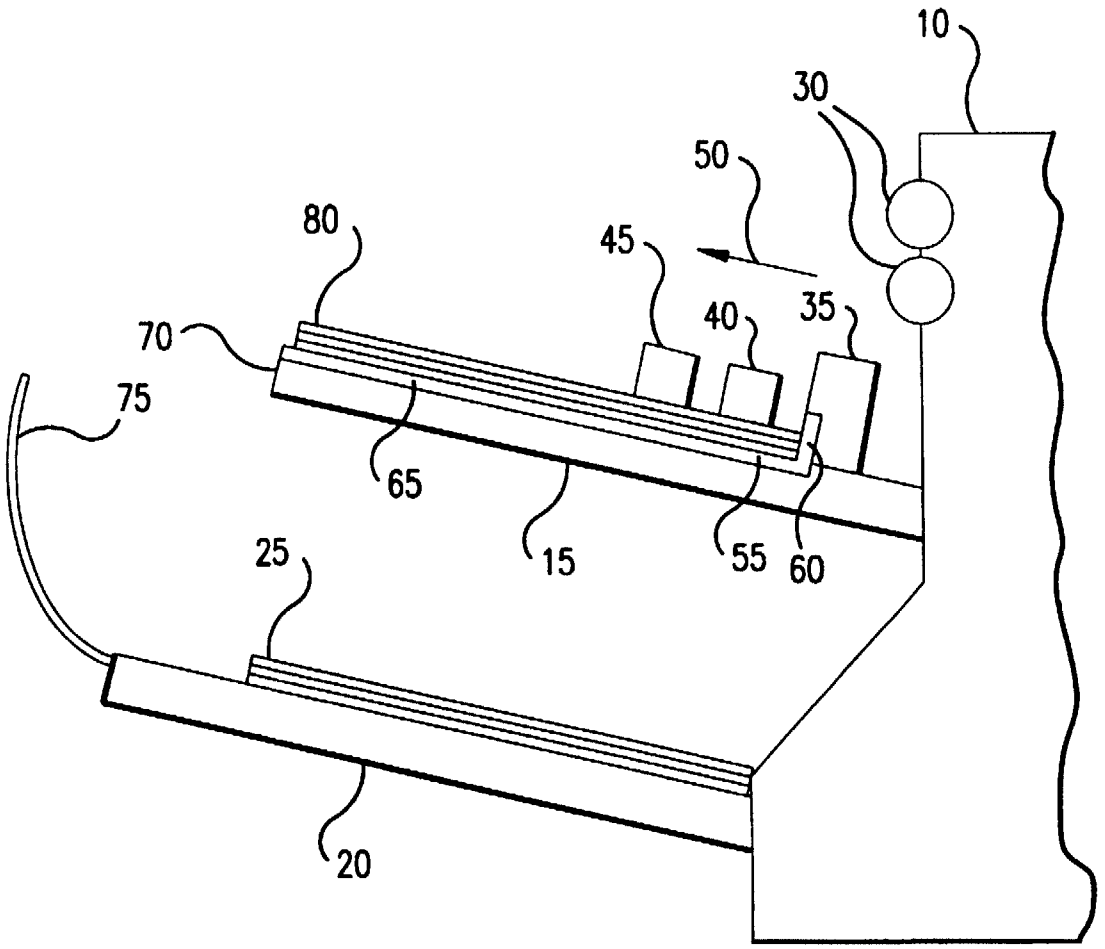

Once the subsequent finishing operation is performed 160 (binding in this example), and if there are no more finishing operations to be completed 170, then the job is transferred 165 to the final output tray. FIG. 4 shows a "snap shot" of how the job is pushed farther forward until it nears dropping over end 70 of intermediate output tray 15. FIG. 5 shows how deflection arm 75 directs the job down to final output tray 20 once the job has been pushed off of tray 15, and FIG. 6 shows the completed job (media 25) at rest in tray 20 where it waits for user pick up.

At this stage, if another (next) job is to be processed 180, then control returns 150 to receive the next job into intermediate output tray 15. FIG. 6 shows how the next job (media 80) is received onto intermediate tray 15 while the first job (media 25) yet remains on final output tray 20. Next job 80 is now ready to be processed as was job 25. This scenario depicts how the present invention is capable of performing finishing operations on more than one job by using the intermediate and final output trays in conjunction with each other. Intermediate output tray 15 may continue finishing operations on new jobs, and final output tray 20 may continue receiving completed jobs until tray 20 is filled to its capacity.

In summary, the present invention allows a paper handling device to perform a finishing operation, such as registration, on a job (one or more sheets of media), and then transport that job to a different location for a next one or more finishing operations (such as binding), and then transport the job again to a separate final output storage location. Accordingly, using principles of the present invention, design implementation flexibility is provided due to the separate locations for each finishing operation, and multiple jobs are capable of being stored in a single final output bin.

What has been described above are the preferred embodiments for media processing using separate intermediate and final output storage locations. It will be obvious to one of ordinary skill in the art that the present invention is easily implemented utilizing any of a variety of components and tools existing in the art. Moreover, while the present invention has been described by reference to specific embodiments, it will be apparent that other alternative embodiments and methods of implementation or modification may be employed without departing from the true spirit and scope of the invention.

What is claimed is:

1. A media processing output apparatus, comprising:

(a) first and second holding beds adapted to receive media thereon;

(b) a first finishing mechanism disposed to cooperate with the first holding bed for performing a first finishing operation on the media; and (c) a push arm disposed in cooperation with the first holding bed for pushing the media from the first holding bed into the second holding bed.

2. (Amended once) The apparatus of claim 1 wherein the first finishing operation is selected from a registration process, a binding process, and a hole punching process.

3. A media processing output apparatus, comprising:

(a) first and second holding beds adapted to receive media thereon;

(b) a first finishing mechanism disposed to cooperate with the first holding bed for performing a first finishing operation on the media;

(c) means for transferring the media in the first holding bed to the second holding bed; and (d) at least a second finishing mechanism disposed to cooperate with the first holding bed and first finishing mechanism for performing a second finishing operation on the media.

4. The apparatus of claim 3 wherein the second finishing operation is selected from a registration process, a binding process, and a hole punching process.

5. The apparatus of claim 3 wherein the second finishing mechanism is disposed down stream from the first finishing mechanism relative to a processing path of the media.

6. The apparatus of claim 3 wherein the first and second finishing mechanisms operate independent of each other.

7. The apparatus of claim 1 wherein the first and second holding beds are output bins.

8. The apparatus of claim 1 wherein the first holding bed is an intermediate output bin, and the second holding bed is a final output bin relative to a processing status of the media.

9. The apparatus of claim 1 wherein the second holding bed is disposed down stream from the first holding bed relative to a processing path of the media.

10. The apparatus of claim 1 wherein the second holding bed is disposed below the first holding bed.

11. The apparatus of claim 3 wherein the means for transferring the media includes a push arm disposed in cooperation with the first holding bed for pushing the media from the first holding bed into the second holding bed.

12. A media output device, comprising:

(a) first and second output trays adapted to receive media thereon, the second output tray being disposed downstream from the first output tray relative to a media processing path;

(b) at least one finishing mechanism connected to the first holding bed for performing a finishing operation on the media in the first holding bed; and, (c) a transfer mechanism connected to the first holding bed for causing a transfer of the media to occur from the first holding bed to the second holding bed.

13. The media output device of claim 12 wherein the finishing operation is selected from a registration process, a binding process, and a hole punching process.

14. The media output device of claim 12 wherein the second output tray is disposed below the first output tray.

15. The media output device of claim 12 wherein the transfer mechanism includes a push arm for pushing the media from the first output tray to the second output tray.

16. A method of finish processing media, comprising:

(a) receiving media into a first holding bed;

(b) performing a first finishing operation on the media in the first holding bed; and, (c) pushing the media into a second holding bed.

17. The method of claim 16 wherein the first finishing operation is selected from a registration process, a binding process, and a hole punching process.

18. A method of finish processing media, comprising:

(a) receiving media into a first holding bed;

(b) performing a first finishing operation on the media in the first holding bed;

(c) transferring the media to a second holding bed; and (d) performing at least a second finishing operation on the media in the first holding bed downstream from the first finishing operation relative to a media processing path.

19. The method of claim 16 wherein the second holding bed is disposed below the first holding bed.

20. The method of claim 18 wherein the step of transferring the media includes pushing the media into the second holding bed.

* * * * *